United States Patent [19]
Marhofer et al.
[11] 3,962,001
[45] June 8, 1976

[54] METHOD OF MANUFACTURING A CAP-SENSITIVE AND NON-SENSITIVE AQUEOUS GEL SUSPENSION EXPLOSIVE

[75] Inventors: Edwin G. Marhofer; Mike L. Marrello; Glenn E. Tolle, all of Pittsburg, Kans.

[73] Assignee: Gulf Oil Corporation, Pittsburgh, Pa.

[22] Filed: Mar. 10, 1975

[21] Appl. No.: 556,754

[52] U.S. Cl. ..... 149/41; 149/60; 149/61; 149/74; 149/76
[51] Int. Cl. ..... C06b 33/14
[58] Field of Search ..... 149/74, 76, 60, 41, 149/61

[56] References Cited

UNITED STATES PATENTS 3,676,236 7/1972 Klima et al. ..... 149/41

*Primary Examiner*—Stephen J. Lechert, Jr.
*Attorney, Agent, or Firm*—Carl A. Cline

[57] ABSTRACT

Non-cap sensitive aqueous gel explosives containing no suspended solid fuels are made by combining water, hexamethylenetetramine, ammonium nitrate, sodium nitrate, ammonium perchlorate and nitric acid, along with sufficient polysaccharide gum to thicken the mixture. These explosives are rendered cap sensitive by mixing therewith paint grade aluminum powder or other conventional sensitizing agents. According to a preferred procedure, a cap sensitive aqueous gel explosive is made by a procedure in which nitric acid and aqueous hexamethylenetetramine solution are first combined under controlled conditions of temperature and pH and ammonium nitrate, sodium nitrate, ammonium perchlorate, thickening agent and aluminum powder are added in controlled amounts in a specified order. The products possess cap sensitivity, even at temperatures as low as minus 23°C.

6 Claims, No Drawings

METHOD OF MANUFACTURING A CAP-SENSITIVE AND NON-SENSITIVE AQUEOUS GEL SUSPENSION EXPLOSIVE

BACKGROUND OF THE INVENTION

Aqueous gel explosives which derive their chemical energy mainly from thermal decomposition of ammonium nitrate are used extensively in quarrying, excavating and mining, primarily because they are cheap and safe to handle. These explosives usually contain expensive suspended solid fuels and cannot be detonated with blasting caps, but require substantial high explosive booster charges to obtain efficient detonation. There are needed both cheaper non-cap sensitive explosives containing no solid fuels or sensitizers and also explosives that can be placed and detonated in a manner similar to dynamite, but which are cheaper and much less prone to accidental detonation. We have discovered that a class of aqueous gel explosives based on ammonium nitrate suspensions can readily be made without the use of suspended solid fuels and can also be converted to cap sensitive form, in which they will serve as relatively safe substitutes for dynamite.

Gelled aqueous ammonium nitrate suspension explosives are known. In U.S. Pat. No. 3,676,236 of Klima et al there are disclosed explosive compositions made up of varying proportions of ammonium nitrate, sodium nitrate, ammonium perchlorate, hexamethylenetetramine, nitric acid, a finely divided solid fuel, a hydroxy-substituted thickening agent and a cross-linking agent. The prior art explosive compositions are particularly useful for placement in rather large, widely spaced drill holes such as are customarily found in open pit hard rock mining. Explosives of this type are customarily detonated by means of blasting caps and high explosive booster charges.

SUMMARY OF THE INVENTION

We have found that non-cap sensitive explosives can be manufactured, using the same ingredients as employed in the prior art but without the necessity of including a finely divided solid fuel therein, providing the proportions of ingredients are kept within narrow ranges, according to the following procedure:

a. preparing a mother liquor consisting of 26 to 36 weight percent water, from 14 to 24 weight percent hexamethylenetetramine, from 30 weight percent to a sufficient quantity of ammonium nitrate to saturate the solution, from 5 to 15 weight percent ammonium perchlorate and sufficient nitric acid to obtain a pH of 4.0 to 6.5 and, b. adding from 80 to 175 parts by weight of particulate ammonium nitrate to each 100 parts of mother liquor prepared in step (a) so as to bring the total water content of the resulting composition to within 13 to 18 weight percent, along with sufficient polysaccharide gum to thicken the mixture to a gel consistency.

A preferred procedure for preparing the mother liquor in step (a) above is as follows:

Mixing with a 30 to 40 weight percent aqueous solution of hexamethylenetetramine, sufficient nitric acid to obtain a pH of 5.0 to 5.3, while controlling the temperature of the resulting mixture so that it does not rise above 66°C, so as to produce an aqueous solution in which the hexamethylenetetramine content is from 25 to 35 weight percent, then in a quantity of this solution dissolving sufficient ammonium perchlorate to yield a final concentration of from 5.0 to 6.0 percent, sufficient sodium nitrate to yield a final concentration of 8.0 to 9.0 percent and sufficient ammonium nitrate to yield a final concentration of 30 to 45 percent.

With this mother liquor there may then be mixed preferably finely ground particulate ammonium nitrate and sufficient thickening agent to form a non-cap sensitive explosive gel in which the ammonium nitrate is suspended. Subsequently, paint grade aluminum powder or other sensitizing agent may be added to convert the composition into a capsensitive substitute for dynamite.

DISCUSSION OF THE METHOD AND PREFERRED EMBODIMENTS

The various steps of the method have critical features from which substantial deviation may lead to failure. The critical aspects of each step are discussed below:

STEP a.

In the beginning of this step an exothermic reaction occurs, if performed as exemplified. Only water, hexamethylenetetramine and nitric acid are preferably present at the beginning so that temperature and pH can be more conveniently controlled. The upper limit of temperature should be strictly observed to prevent decomposition from occurring as a side reaction. Preferably the temperature is controlled between 50° and 60°C.

Since the dissolving of ammonium nitrate is endothermic, this can be accomplished more quickly and conveniently by providing additional heat through a steam coil or other heat exchange means. Preferably, enough heat is supplied during this step to yield a final temperature of 35° to 50°C in preparation for step (b).

STEP b.

If desired, the solution produced in step (a) can be kept in storage and portions of it may be used as mother liquor to prepare a variety of explosive products. It is more economical and convenient, however, to use this solution as it comes from step (a) before it becomes cool. The ammonium nitrate employed in this step should be finely ground and free of lumps. The combination of polysaccharide gum and cross-linking agent should be chosen from among those available on the market for the ability to gel a suspension of the sort produced in this step. Some gums do not produce a sufficiently firm gel at the pH of this suspension (about 5.8–5.9).

STEP c.

it is essential that this sensitizing step is performed only after the suspension of step (b) has become thickened. It is also essential that mixing is stopped as soon as uniform appearance of the product is achieved. Further mixing is detrimental to sensitivity.

In the following specific examples there are illustrated the preparation of a variety of both cap-sensitive and non-cap-sensitive products.

EXAMPLE 1

In a clean stirred reaction vessel there was placed 8,349 parts of water. To this there was added, with stirring, 4,914 parts of solid particulate hexamethylenetetramine and stirring was continued until solution was obtained.

To this solution there was added 1,988 parts of nitric acid (69%, 42° Baume) while stirring and controlling temperature within a range of about 45° to 60°C during the evolution of heat, continuing mixing after all reaction had ceased, as indicated by stability of pH and a decrease in temperature. At this stage the pH measured from 5.1 to 5.3 at 38°C.

To this solution there was then added 10,602 parts of prilled ammonium nitrate with stirring, while heating the reactor with a steam jacket. While maintaining a temperature approaching 50°C there was also dissolved in the mixture 1,551 parts of ammonium perchlorate and 2,586 parts of sodium nitrate. Properties of the finished solution as measured on a series of batches prepared as described above, were as follows:

| | |
|---|---|
| pH | 5.8 to 5.9 |
| Specific gravity | 1.34 to 1.35 g/cc |
| Crystallization temperature minus | 4°C |

The solution as described above was then employed as liquid phase to form a gelled suspension as described below, operating at a temperature between 38° and 49°C.

Into a mixing vessel was placed 1,960 parts of finely ground ammonium nitrate. A sufficient quantity of the above-described liquid was then added, with mixing, to form a slurry which was smooth and free of lumps. The remainder of a total of 2,000 parts of the above-described liquid was then added, with stirring, along with 40 parts of guar gum with cross-linking agent which was added through eductors at such a rate that mixing was thorough and no lumps formed. The thickened suspension was allowed to reach gel consistency, which required about eight to ten minutes after addition of guar gum was complete. The product consisted of 4000 parts by weight of a non-cap-sensitive aqueous gel suspension explosive having a density of 1.20 to 1.25 g/cc and a pH between 5.9 and 6.2. The percentages of various components in the finished composition (to one decimal place) were as follows:

| INGREDIENTS | % BY WT. |
|---|---|
| Water | 14.9 |
| Nitric Acid (100% basis) | 2.3 |
| Hexamethylenetetramine | 8.2 |
| Ammonium Nitrate in solution | 17.7 |
| Ammonium Perchlorate | 2.6 |
| Sodium Nitrate | 4.3 |
| Ammonium Nitrate (ground) | 49.0 |
| Guar Gum (NGL 4779, New, FF) (Stein-Hall) with Cross Linker RO (Stein-Hall) | 1.0 |

EXAMPLE 2

Step (a) was performed according to the method of this invention to yield a solution made up from the following raw materials:

| | | |
|---|---|---|
| Hexamethylenetetramine | 15.3 | weight percent |
| water | 30.6 | |
| Nitric acid | 6.5 | |
| Ammonium perchlorate | 5.1 | |
| Sodium nitrate | 8.5 | |
| Ammonium nitrate | 34.0 | |
| | 100.0 | weight percent |

To 58.8 parts of the above solution was added 36.3 parts of finely ground ammonium nitrate and 0.9 parts of guar gum with crosslinking agent (Stein-Hall NGL 4779 New, FF with crosslinker RO) with thorough mixing. After the resulting mixture set to a gel consistency, 4.0 parts of leafing grade aluminum pigment powder was mixed in until a uniform appearance was obtained. Mixing was then stopped.

The product was detonatable with a number 6 electric blasting cap in a charge having a diameter of 1.25 inches (3.2 cm) at temperatures as low as minus 17.8°C. with a detonation velocity of 10,000 ft (3,045m) per second. The gel structure of the product conferred excellent water resistance. After storage for 3 months at 48.9°C there was no loss of sensitivity or breakdown of gel structure.

EXAMPLE 3

A series of batches of explosive was made according to the procedure described below.

In a clean stirred reactor vessel there was placed 8,349 parts of water. To this there was added, with stirring, 4,914 parts of solid particulate hexamethylenetetramine and stirring was continued until solution was obtained.

To this solution there was added 1,988 parts of nitric acid (69%; 42° Baume) while stirring and controlling temperature within a range of about 45° to 60°C during the evolution of heat, continuing mixing after all reaction had ceased, as indicated by stability of pH and a decrease in temperature. At this stage the pH measured from 5.1 to 5.3 at 38°C on various batches made by this procedure.

To this solution there was then added 10,602 parts of prilled ammonium nitrate with stirring, while heating the reactor with a steam jacket. While maintaining a temperature approaching 50°C there was also dissolved in the mixture 1,551 parts of ammonium perchlorate and 2,586 parts of sodium nitrate. Properties of the finished solution as measured on a series of batches prepared as described above, were as follows:

| | |
|---|---|
| Ph | 5.8 to 5.9 |
| Specific gravity | 1.34 to 1.35 g/cc |
| Crystallization temperature minus | 4°C |

The solution as described above was then employed as liquid phase to form a gelled suspension as described below, operating at a temperature between 38° and 49°C.

Into a mixing vessel was placed 1,480 parts of finely ground ammonium nitrate. A sufficient quantity of the above-described liquid was then added, with mixing, to form a slurry which was smooth and free of lumps. The remainder of a total of 2,320 parts of the above-described liquid was then added, with stirring, along with 40 parts of guar gum which was added through eductors at such a rate that mixing was thorough and no lumps formed. The thickened suspension was allowed to reach gel consistency during a period of at least 5 minutes, while continuing to mix slowly. After gel formation appeared to be complete, then 160 parts of paint pigment grade aluminum powder was mixed in at low speed until a uniform appearance was obtained. As soon as this appearance was obtained, mixing was stopped. The product was 4000 parts of a stable, cap sensitive aqueous gel explosive. Properties of a series of batches made by repetition of this procedure were as follows:

| | |
|---|---|
| pH | 5.9 to 6.2 |
| Specific gravity | 1.10 to 1.15 g/cc |
| Classification High Explosive | Class A |
| Cap-sensitive at temperatures as low as minus 23°C | |

The product made according to the procedure of this example was composed of 9.5 percent hexamethylenetetramine, 2.7 percent nitric acid, 57.5 percent ammonium nitrate, 5 percent sodium nitrate, 3 percent ammonium perchlorate, 4 percent paint pigment grade aluminum powder, one percent guar gum with crosslinker and water.

We claim:

1. The method of manufacturing a cap-sensitive aqueous gel suspension explosive consisting essentially of the steps:

a. Mixing with a 30 to 40 weight percent aqueous solution of hexamethylenetetramine sufficient nitric acid to obtain a pH of 5.0 to 5.3, while controlling the temperature of the resulting mixture so that it does not rise above 66°C, so as to produce an aqueous solution in which the hexamethylenetetramine content is from 25 to 35 weight percent; then dissolving in this solution sufficient ammonium perchlorate to yield a concentration of from 5.0 to 6.0 percent, sufficient sodium nitrate to yield a concentration of 8.0 to 9.0 percent and sufficient ammonium nitrate to yield a concentration of 30 to 45 percent in the resulting solution;

b. into each 100 parts of the solution resulting from step (a) mixing thoroughly 60 to 65 parts by weight of finely ground ammonium nitrate and sufficient polysaccharide gum and crosslinking agent to thicken the mixture to a gel-like consistency;

c. after the mixture produced in step (b) has become thickened, mixing from 6 to 8 parts of paint pigment grade aluminum powder therewith until the mixture is uniform in appearance.

2. The cap-sensitive explosive product made according to the method of claim 1.

3. The cap-sensitive explosive product made according to the method of claim 1 composed of 9.5 percent hexamethylenetetramine, 2.7 percent nitric acid, 57.5 percent ammonium nitrate, 5 percent sodium nitrate, 3 percent ammonium perchlorate, 4 percent paint pigment grade aluminum powder, 1 percent guar gum with crosslinker and water.

4. The method of manufacturing a non-cap sensitive aqueous gel explosive containing no suspended solid fuel consisting essentially of the steps:

a. preparing a mother liquor consisting of 26 to 36 weight percent water, from 14 to 24 weight percent hexamethylenetetramine, from 30 weight percent to a sufficient quantity of ammonium nitrate to saturate the solution, from 5 to 15 weight percent ammonium perchlorate and sufficient nitric acid to obtain a pH of 4.0 to 6.5 and, b. adding from 80 to 175 parts of particulate ammonium nitrate to each 100 parts of the mother liquor prepared in step (a) so as to bring the total water content of the resulting composition to within 13 to 18 weight percent, along with sufficient polysaccharide gum to thicken the mixture to a gel consistency.

5. The non-cap sensitive aqueous gel explosive made by the process of claim 4.

6. The non-cap sensitive aqueous gel explosive made by the process of claim 4 composed of 8.2 percent hexamethylenetetramine, 2.3 percent nitric acid, 66.7 percent ammonium nitrate, 4.3 percent sodium nitrate, 2.6 percent ammonium perchlorate, one percent guar gum with crosslinker and water.

* * * * *